United States Patent [19]

Kiyonoga

[11] 4,313,756

[45] * Feb. 2, 1982

[54] PROCESS FOR UPGRADING IRON ORE PELLETS

[75] Inventor: Kazuo Kiyonoga, Tarrytown, N.Y.

[73] Assignee: Union Carbide Corporation, New York, N.Y.

[ * ] Notice: The portion of the term of this patent subsequent to Feb. 2, 1999, has been disclaimed.

[21] Appl. No.: 862,203

[22] Filed: Dec. 19, 1977

Related U.S. Application Data

[63] Continuation-in-part of Ser. No. 712,138, Aug. 6, 1976, abandoned.

[51] Int. Cl.[3] ..... C22B 1/14

[52] U.S. Cl. ..... 75/3; 266/178

[58] Field of Search ..... 266/177, 178, 179, 180, 266/185; 75/3, 4, 5, 33, 34, 35

[56] References Cited

U.S. PATENT DOCUMENTS

| | | | |
|---|---|---|---|
| 2,952,533 | 9/1960 | Cuscoleca et al. | 75/41 |
| 3,158,463 | 1/1964 | Petkovich | 75/5 |
| 3,259,483 | 7/1966 | Austin | 75/3 |
| 3,264,092 | 8/1966 | Ban | 75/3 |
| 3,313,617 | 4/1967 | Ban et al. | 75/5 |

OTHER PUBLICATIONS

Bennett, et al., *American Institute of Chemical Engineers,* vol. 59, p. 47 (1963).

Knepper, W. A., *Agglomeration,* Interscience Publishers, pp. 931, 954–955. (1962).

Ball, et al., *Agglomeration of Iron Ores,* Heinemann Educational Books Ltd. pp. 42–46 (1973).

*Primary Examiner*—Michael L. Lewis

*Attorney, Agent, or Firm*—Saul R. Bresch

[57] ABSTRACT

In a process for hardening oxidizable green iron ore pellets in a closed grate-kiln furnace adapted therefor, and in which zone the flow of gases is in a downward direction towards the bed of pellets on the grate the improvement comprising:

(a) covering the periphery of at least part of the zone with at least two hoods to provide a hooded area on each side of the top of the grate under which the periphery of the grate passes, the distance between the inner edges of the periphery of the grate, as measured horizontally from inner edge to inner edge across the width of the grate along a line perpendicualr to the path of the grate, being at least about 4 feet, and the hoods being located below the theoretical midpoint between the top of the pellet bed and the roof of the furnace; and (b) passing at least one gas stream consisting essentially of oxygen within each hooded area in such a manner that the stream flows in a downward direction towards and through the periphery of the bed of pellets on the grate passing through the hooded areas, the amount of oxygen being in excess of that theoretically required to convert any magnetite in the periphery to hematite.

3 Claims, 2 Drawing Figures

PROCESS FOR UPGRADING IRON ORE PELLETS

This application is a continuation-in-part of application Ser. No. 712,138 filed Aug. 6, 1976, now abandoned.

FIELD OF THE INVENTION

This invention relates to a process for upgrading iron ore pellets in a grate-kiln furnace as the pellets undergo hardening.

DESCRIPTION OF THE PRIOR ART

The pelletizing of iron ore concentrates for use as charge material in blast furnaces has been gaining in importance in the steel industry. This is the result of an attempt to meet the increased demand for iron and steel with lower quality ores and ores extracted from beneficiation plants, all of which are usually in the form of finely divided particles, too finely divided for direct processing in a blast furnace.

The primary purpose of pelletizing in this industry is to improve burden permeability and gas-solid contact in the blast furnace in order to increase the rate of reduction. A secondary consideration is to reduce the amount of fines blown out of the blast furnace into the gas recovery system.

Characteristics of industrially acceptable pellets are those that are strong enough to withstand degradation during stockpiling, handling, and transportation and have the capability to withstand the high temperature and degradation forces within the blast furnace without slumping or decrepitating.

Typical pelletizing processes comprise forming $\frac{3}{8}$ inch to 1 inch diameter balls of iron ore concentrate of reasonable moisture content in a rotating drum or on a rotating disc and then firing the "green" balls or pellets in a furnace to a sufficiently high temperature to harden the pellets to a strength suitable for use in blast furnaces. The green pellets of interest here are those which contain an oxidizable material, usually magnetite ($Fe_3O_4$). Other oxidizable materials are iron and solid fuel such as coke, coal, or charcoal, which is sometimes added to the balling mix in a finely divided state in order to provide additional heat to the pellets during the hardening operation. The iron ore concentrate with which we are particularly concerned here contains at least about 30 percent magnetite; some iron or other iron compounds such as hematite; and a small amount of impurities such as silica, alumina and magnesia. One of these concentrates is known as beneficiated taconite. Binders are often added before or during the drum or disc rotation to increase wet strength of the green pellets to acceptable levels for subsequent handling.

One of the basic types of furnaces used commercially for hardening green pellets is the grate-kiln furnace. In this furnace, typically, green pellets are first fed onto a chain grate where they are dried and preheated by a two-pass system using the gases from the rotary kiln. The preheated pellets then drop into the kiln where they undergo induration and are brought up to the final pelletizing temperature of about 2400° F. before being discharged into a cooler. Air, which is used to recover the sensible heat from the hot pellets, is then used as secondary air in the rotary kiln. The secondary air temperature is raised to about 2400° to 2500° F. by use of a burner located at the discharge end of the rotary kiln. In the preheating area of the furnace, there is a zone in which the average pellet temperature is in the range of about 1100° F. to about 2200° F., which zone is of interest here and has not heretofore been delineated.

Strong bonding in the hardened pellets produced in the grate-kiln furnace is believed to be due to grain growth from the accompanying oxidation of magnetite to hematite and to recrystallization of the hematite. The exothermic oxidation reaction typically supplies about 300,000 Btu's (British thermal units) per long ton of pellets.

Hardened pellet strength is usually determined by compression and tumbler tests. Although specifications for pellets vary depending on their source and the purchaser, the minimum suggested compressive strength for individual pellets ranges from about 300 pounds for $\frac{1}{4}$ inch pellets to about 800 to about 1500 pounds for 1 inch pellets. In the tumbler test, 25 pounds of plus $\frac{1}{4}$ inch pellets are tumbled for 200 revolutions at $24 \pm 1$ rpm (revolutions per minute) in a drum tumbler and then screened. Satisfactory commercial pellets generally yield less than about 6 percent of minus 28 mesh fines and more than 90 percent of plus $\frac{1}{4}$ inch pellets after the tumble test. In some cases, the tumble index has been modified to measure only the plus $\frac{1}{4}$ inch pellets present before and remaining after the tumble test and the price paid per long ton of pellets shipped is adjusted accordingly. Since production at a pelletizing plant is in the millions of tons per year range, a small improvement in tumble index (quality) of about 2 percentage points, for example, can represent significant additional income to the plant.

It is understood by those skilled in the art that one of the important factors in improving the quality of the pellets, both in terms of compressive strength and tumble index, is to provide for a more efficient conversion of magnetite to hematite in the furnace, the goal being, of course, one where all of the pellets produced are essentially hematite, or, at least, of higher hematite content.

Oxidation of magnetite to hematite during the pelletizing process is important not only because hematite is reduced more readily in the blast furnace in spite of its higher oxygen content, but also because in the pelletizing process, conversion of magnetite to hematite which is a strongly exothermic reaction, favors grain growth and sintering of the particles of iron ore concentrate to form hard, strong pellets that are abrasion resistant.

Since the reaction rate of magnetite in substantially pure oxygen is manyfold greater than that in air, it has been suggested that the combustion gases and air in the furnace be enriched with oxygen; however, the volume of gases circulating in a pelletizing plant is so large that any significant increase in oxygen concentration requires uneconomic amounts of oxygen, i.e. the cost of oxygen needed to provide higher numbers of pellets of essentially hematite or higher hematite content exceeds the additional income generated by the higher quality pellets. Further, it is recognized that a large percentage of the additional oxygen is wasted, in any case, because it flows over pellets, which would be converted to essentially hematite or at least a sufficient hematite content in a conventional operation.

SUMMARY OF THE INVENTION

An object of this invention, therefore, is to provide an improvement over conventional pelletizing processes whereby the hematite content of the hardened pellets is increased and the overall quality of pellets thereby improved.

Other objects and advantages will become apparent hereinafter.

According to the present invention, such an improvement has been discovered in a process for hardening oxidizable green iron ore pellets in a closed grate-kiln furnace adapted therefor, said process comprising passing the grate with a bed of pellets thereon along a horizontal path through the furnace to dry and preheat the pellets and then introducing the pellets into the kiln to undergo additional heating and induration, all by contact with hot gases, said grate passing through a preheating zone in which the average pellet temperature in the bed is in the range of about 1100° F. to about 2200° F. and in which zone the flow of gases is in a downward direction towards the bed of pellets on the grate.

The improvement comprises:

(a) covering the periphery of at least part of the zone with at least two hoods to provide a hooded area on each side of the top of the grate under which the periphery of the grate passes, the distance between the inner edges of the periphery of the grate, as measured horizontally from inner edge to inner edge across the width of the grate along a line perpendicular to the path of the grate, being at least about 4 feet, and the hoods being located below the theoretical midpoint between the top of the pellet bed and the roof of the furnace; and (b) passing at least one gas stream consisting essentially of oxygen within each hooded area in such a manner that the stream flows in a downward direction towards and through the periphery of the bed of pellets on the grate passing through the hooded areas, the amount of oxygen being in excess of that theoretically required to convert any magnetite in the periphery to hematite.

DESCRIPTION OF THE PREFERRED EMBODIMENT

Figure 1:
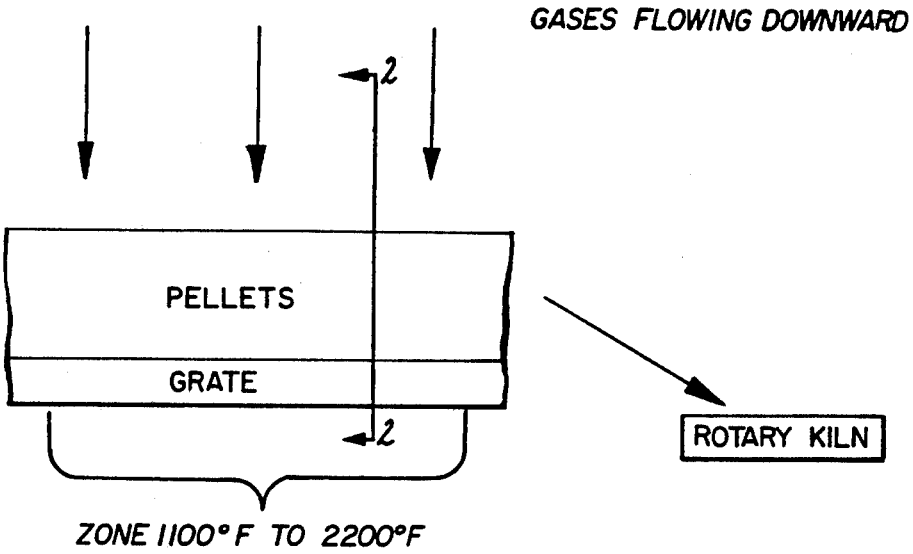

The preparation of the green pellets has been referred to above and is conventional. This invention is directed to that part of the pelletizing process whereby green pellets are hardened to the extent required for use in the blast furnace. As also noted, the apparatus, i.e. the grate-kiln furnace, for carrying out the hardening aspect, the initial composition of the green pellets, the basic steps in the hardening process, and the combustion gases and air (referred to as gases) used in the process are conventional and are utilized here together with subject improvement.

The improvement here involves directing oxygen streams at the pellets passing through the periphery of a particular temperature zone under a set of defined conditions. As noted, the zone is present in conventional grate-kiln furnace operations, but until now has not been identified other than as part of a section of the furnace where preheating takes place.

The selected zone is that where the average pellet temperature is in the range of about 1100° F. to about 2200° F. and preferably about 1300° F. to about 2000° F. Further, the zone must be one where the gases in the furnace are flowing downward towards the pellets on the grate.

The oxygen system can be a mixture of gases containing a major proportion or more than 50 percent by volume oxygen. It is preferably a mixture of gases containing at least about 90 or 95 percent by volume oxygen, however. The usual oxygen distributed commercially is considered to consist essentially of oxygen and it is expected that this oxygen would be the most easily obtained.

It is found that, by directing oxygen at the pellets in the periphery of the selected temperature zone under the defined conditions, maximum oxidation can be achieved with minimum oxygen consumption and the temperature of the pellets is raised thereby to provide more efficient thermal bonding which additionally raises the overall quality of the pellets.

The furnace is a "closed" structure, which means that it has a roof, side-walls, and a bottom wall. The structure is not completely air-tight, however. In order to control the flow of gases, the structure is divided up into compartments with vertical walls, the grate passing through these compartments along its path. The grate is about 6 feet to about 20 feet in width or greater with the trend being towards wider grates.

A typical grate-kiln furnace is described in "Agglomeration of Iron Ores", Ball et al, Heinemann Educational Books Ltd., 1973, at pages 42 to 46 (see FIG. 5.5). This description is incorporated by reference herein.

The periphery of the zone is that area on both sides of the top of the grate running from the inside surface of each retaining wall horizontally towards the center of the grate. The retaining wall is a part of and attached to the grate and is there for the purpose of keeping the pellets from falling off the moving grate. A typical retaining wall is about 8 inches high. It forms a right or oblique angle with the horizontal surface of the grate. The grate, retaining wall, and pellets all move together through the furnace. The distance from the inside surface of the retaining wall towards the center of the grate to be included in the peripheral area is selected by analysis (in a conventionally run process) of samples of the pellets passing through the zone to determine the location of the bulk of the incompletely oxidized pellets. Although the width of the grates, i.e., measured horizontally across the grate, varies from grate to grate, the distance included in the periphery is about 3 inches to about 24 inches as measured horizontally from the top of the inside surface of the retaining walls towards the center of the grate along a line perpendicular to the line of travel or direction of the grate. The periphery of the zone includes and is coextensive in a horizontal direction with the periphery of the grate and the periphery of the pellet bed. As pointed out above, the distance between the inner edges (the edges closest to the center of the grate) of the periphery, as measured horizontally from inner edge to inner edge across the width of the grate along a line perpendicular to the path of the grate, is at least about 4 feet.

The flow of oxygen stream is in a downward direction towards the bed of pellets on the horizontal grate. Where the retaining wall is oblique, the direction of the flow is the same even though the pellets against the retaining wall are not on the horizontal. The stream first strikes the top of the pellet bed and then passes down through the bed and through the grate, the oxygen declining in amount as it reacts with the oxidizable materials in the pellet.

Usually, the introduction or injection of the oxygen stream into the hooded area is made in the desired downward direction, but it can be introduced into the hooded area in any direction, e.g., in a horizontal direction from the sides of the hood, and dispersed within the hood, which will serve to direct the flow in the downward direction.

One or more hoods are provided on each side of the grate to cover the periphery. The hoods are made of conventional materials which will withstand furnace temperatures. Refractories are usually used. The oxygen stream is introduced under the hood in such a manner that the downward flow referred to above is accomplished whether directly or indirectly. The introduction under the hood can be through an open pipe, a capped and perforated pipe, or through a series of jets which are located to follow the path of the pellets. The hood serves to obstruct the flow of furnace gases over that area of the periphery which it serves and minimizes dilution of the oxygen streams within the hooded area.

Referring to the drawing,

FIG. 1 is a schematic diagram of a side view of a center section of the grate and rotary kiln inside of a grate-kiln furnace (without the hoods).

Figure 2:
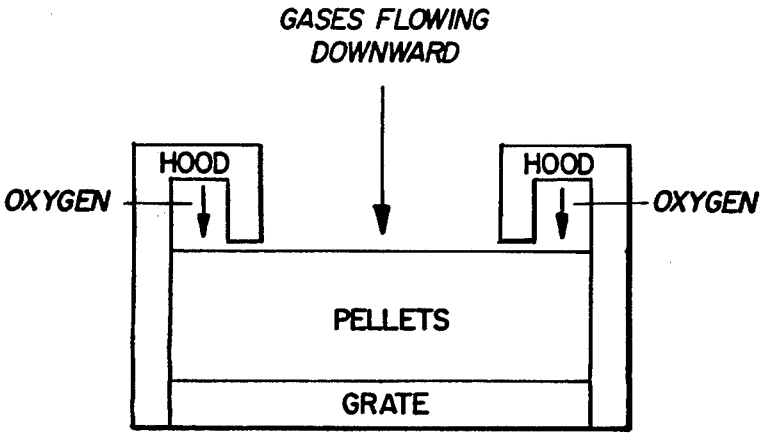

FIG. 2 is a front view cross section taken along line 2—2 of FIG. 1 showing the hoods. The superstructure of the closed furnace which envelopes the grate, pellets, and the hoods is not shown. As pointed out above, the hoods are located below the theoretical midpoint between the top of the pellet bed and the roof of the furnace.

It will be understood by those skilled in the art that the terms "hood" or "hooded area" contemplate the utilization of enclosures, canopies, closed end tunnels, tents, compartments or any shielding device which permits the oxygen stream to contact the pellets without essentially being diluted by the furnace gases while permitting the unreacted oxygen to join the main stream of the furnace gases; avoidance of dilution is accomplished by allowing very little clearance between the edges of the hood and the pellet bed, the clearance being just sufficient to permit the pellet bed to pass freely under the hood. It is preferred that the clearance be no more than about 0.5 inch. The width of the hood, i.e., that part measured from the top of the inside surface of the retaining wall horizontally towards the center of the grate is sufficient to cover the periphery of the zone as described above. The length of the hood, i.e., that dimension measured along a line running parallel to the movement of the grate is sufficient to provide the required residence time for the incompletely oxidized pellets in the hooded area, the residence time being at least about 5 seconds and preferably at least about 10 seconds. It will be understood that the entire length of the zone within the periphery does not have to be subjected to oxygen treatment but only a sufficient length to insure that the residence time condition for the peripheral pellets is met. There is no upper limit for residence time except the bounds of practicality, i.e., when complete oxidation has been achieved, although an upper limit of about 30 seconds is preferred.

Typically, the grate moves at about 50 to about 250 inches per minute and the flow of oxygen is kept constant. Therefore, the length of the hood is adjusted to provide the required residence time of 15 seconds and assuming the grate is moving at a rate of 200 inches per minute, the internal length of the hood may be readily calculated as follows:

$$\text{internal length of hood} = \frac{200 \text{ inches}}{\text{minute}} \times \frac{\text{minute}}{60 \text{ seconds}} \times 15 \text{ seconds} = 50 \text{ inches}$$

The most desirable location for the hood is near the hot end of the grate section before the pellets are tumbled into the rotary kiln. An additional advantage of subject process is that oxidation, which usually occurs in the cooler of a conventionally operated grate-kiln, is essentially avoided thus maintaining proper operation and efficiency of the cooler.

The amount of oxygen supplied to the periphery of the zone is usually sufficient to convert essentially all of the magnetite in the periphery of the zone to hematite as determined on a theoretical basis. The same analysis as mentioned above for the determination of flow rate can, of course, be used to determine this amount. It is preferred that about 0.3 mole to about 2 moles of oxygen be used for each mole of magnetite passing through the periphery of the defined zone. The higher the quality of the pellet product desired, the higher the amount of oxygen which may be used, however. In any case, the quality will be upgraded.

I claim:

1. In a process for hardening oxidizable green iron ore pellets in a closed grate-kiln furnace adapted therefor, said process comprising passing the grate with a bed of pellets thereon along a horizontal path through the furnace to dry and preheat the pellets and then introducing the pellets into the kiln to undergo additional heating and induration, all by contact with hot gases, said grate passing through a preheating zone in which the average pellet temperature in the bed is in the range of about 1100° F. to about 2200° F. and in which zone the flow of gases is in a downward direction towards the bed of pellets on the grate, the improvement comprising:

(a) covering the periphery of at least part of the zone with at least two hoods to provide a hooded area on each side of the top of the grate under which the periphery of the grate passes, the distance between the inner edges of the periphery of the grate, as measured horizontally from inner edge to inner edge across the width of the grate along a line perpendicular to the path of the grate, being at least about 4 feet, and the hoods being located below the theoretical midpoint between the top of the pellet bed and the roof of the furnace; and (b) passing at least one gas stream consisting essentially of oxygen within each hooded area in such a manner that the stream flows in a downward direction towards and through the periphery of the bed of pellets on the grate passing through the hooded areas, the amount of oxygen being in excess of that theoretically required to convert any magnetite in the periphery to hematite.

2. The process defined in claim 1 wherein the pellets in the zone have an average temperature in the range of about 1300° F. to about 2000° F.

3. The process defined in claim 2 wherein the residence time is at least about 5 seconds.

* * * * *